United States Patent [19]

Ducasse

[11] Patent Number: 4,496,104

[45] Date of Patent: Jan. 29, 1985

[54] AUTOMATIC SPRINKLING DEVICE

[76] Inventor: Joseph C. V. Ducasse, 391 Donegal Pl., Martinez, Calif. 94553

[21] Appl. No.: 380,992

[22] Filed: May 21, 1982

[51] Int. Cl.[3] ..... B05B 03/04

[52] U.S. Cl. ..... 239/240

[58] Field of Search ..... 239/255, 256, 240, 241, 239/242, DIG. 1, 230, 236, 237

[56] References Cited

U.S. PATENT DOCUMENTS

| | | | |
|---|---|---|---|
| 1,637,413 | 8/1927 | Elder | 239/240 X |
| 2,739,839 | 3/1956 | Greener et al. | 239/DIG. 1 |
| 3,107,056 | 10/1963 | Hunter | 239/242 X |
| 3,141,909 | 7/1964 | Mayo, Jr. | 239/240 X |
| 3,578,248 | 5/1971 | Congdon et al. | 239/242 |
| 4,019,686 | 4/1977 | Palma | 239/DIG. 1 |
| 4,201,344 | 5/1980 | Lichte | 239/242 |
| 4,253,608 | 3/1981 | Hunter | 239/242 X |
| 4,281,793 | 8/1981 | DeWitt | 239/DIG. 1 |

*Primary Examiner*—John J. Love
*Assistant Examiner*—Mary McCarthy
*Attorney, Agent, or Firm*—Wenderoth, Lind & Ponack

[57] ABSTRACT

A sprinkling device includes a casing provided with control means and carrying internally two turbine wheels with a propeller and deflector and externally a rotary union for mounting onto a source of fluidic material under pressure and a nozzle which during operation can be made to move around in a plane between any two points and in either direction automatically while simultaneously discharging forwardly a stream of the fluidic material back and forth.

11 Claims, 8 Drawing Figures

AUTOMATIC SPRINKLING DEVICE

BACKGROUND OF THE INVENTION

1. Field of the Invention

This invention relates to an automatic sprinkling device and more particularly to such a device that can be preset through control means for spraying a specific area during operation, whether being used for watering land or as a fire extinguisher and the like.

2. Description of the Prior Art

Automatic sprinkling devices have long been used either singly or collectively for various purposes such as watering land, extinguishing fires, etc. However, most of them do not have control means for presetting and covering a specific area during operation, while those which do are unreliable due to their inefficiency.

SUMMARY OF THE INVENTION

Accordingly, the primary object of the present invention is to provide a highly reliable and efficient automatic sprinkling device.

A particular object of the invention is to provide such a sprinkling device in combination with highly precised mechanical control means.

Another object of the invention is to provide such a sprinkling device of compact and relatively simple design.

The above objects are achieved in accordance with the present invention by the provision of a casing provided with control means and carrying internally two turbine wheels with a propeller and deflector and externally a rotary union for mounting onto a source of fluidic material under pressure and a nozzle which during operation can be made to move around in a plane between any two points and in either direction automatically while simultaneously discharging forwardly a stream of the fluidic material back and forth.

The casing includes two hollow circular members in the form of a tee and carries the nozzle at the top and the rotary union at the bottom. The propeller is located within the casing horizontal member and includes two blades each provided at one end with a stub shaft and disposed perpendicularly with respect to each other along a common axis, with the stub shafts extending into bearings concentrically provided at each end of the casing horizontal member.

The control means include a ring concentrically attached to one side of one of the propeller blades with its rim provided with four circular concave slots or recesses one of which receives a ball positioned on top of a spring-loaded vertical rod extending downwardly through the casing and provided at the bottom with a taut flexible element extending vertically downward through superposed stationary brackets attached to the casing. Stationary clips are mounted on the rotary union and carry interceptor screws that can be adjusted to timely interfere with the flexible element, thereby pulling down the rod and releasing from the checking action of the ball the ring. The smaller turbine wheel then rotates along with the propeller blades whose relative positions are thus gradually reversed while automatically reversing the direction of rotation of the casing.

The turbine wheels are of different diameters and concentrically mounted within the casing horizontal member both wheels lying in a common radial vertical plane, one mounted within the other. The two wheels are positioned between the propeller blades. Rotation of the ring is timed and effected only when released from the checking action of the ball by means of one of the turbine wheels (the smaller) which is rigidly attached to the propeller blades and thus subject to the checking action of the ball.

The other turbine wheel (the larger) is freely mounted to rotate around the outer periphery of the smaller turbine wheel and carries two flaps at its outer periphery which as they rotate obstruct periodically and partially the flow of fluidic material to the nozzle, thus causing the back and forth pattern of the stream of material being discharged from the nozzle.

BRIEF DESCRIPTION OF THE DRAWINGS

These and other objects and many of the attendant advantages of the invention will become better understood to those skilled in the art by reference to the following detailed description when viewed in light of the drawings wherein.

DETAILED DESCRIPTION OF THE INVENTION

Figure 1:
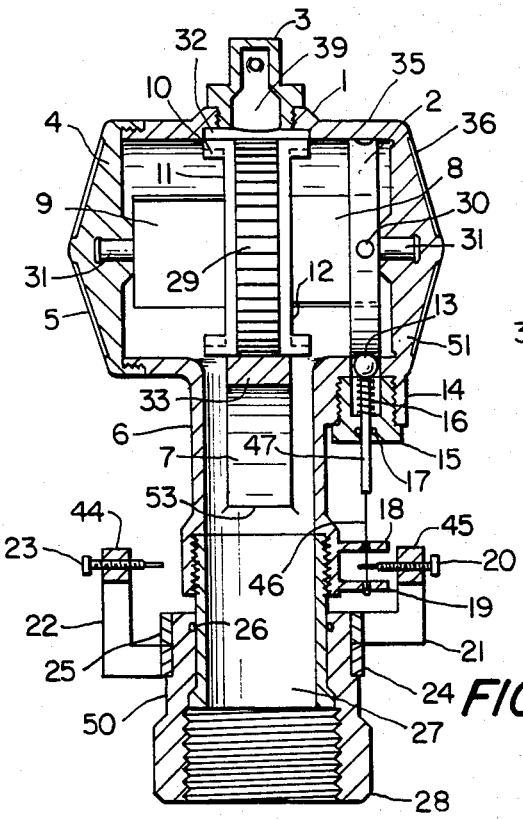
FIG. 1 is an elevation view showing the components of a device in accordance with the present invention, with only the casing being shown in cross-section.

Referring to the drawings, the device includes a hollow T-shaped casing 1 including a vertical cylindrical member 6 connected to a horizontal cylindrical member 51 and carrying at the top a nozzle 3 and at the bottom a rotary union 50 which includes a stationary coupling 28 and a vertical rotary pipe 27 fitted with a seal 26 and concentrically connected to vertical member 6. Forming part of horizontal member 51 is a cover 4 concentrically mounted on one side thereof. Nozzle 3, here shown as being of the angle type, has a spout 38 connecting to the inside of member 51 via a port 39 and a recess 32 provided within member 51, port 39 having its axis lying in line with that of vertical member 6.

The external end surface of cover 4 and that of horizontal member 51 opposite to cover 4 are here shown respectively provided with radial serrations 5 and 36 to facilitate mounting of the device. A circular notch 35 around the outer periphery of member 51 may be also provided as shown merely to provide symmetrical outside configuration or appearance of the device.

Within member 51 and concentrically disposed along its horizontal axis are two turbine wheels 41 and 11 (the smaller wheel 41 being mounted within the larger wheel 11). Two blades 8 and 9 rigidly connected to wheel 41 and extending axially from opposite sides thereof in planes perpendicular to one another, thus forming a propeller, with the tips of the blades being spaced from the inner wall of member 51. Two stub shafts 31 are attached to respective blades 8 and 9 and extend into respective bearings 37 located at one side in cover 4 and at the other side in the end of the body of casing 1.

Turbine wheel 41 includes two parallel annular-shaped plates 42 spaced a distance apart and connected rigidly together by means of a plurality of curved vanes 40 disposed similarly to those of a so-called "Francis" or radial-flow turbine wheel. Rotatably mounted over the rims of plates 42 of wheel 41 is the larger turbine wheel 11 comprising two parallel annular-shaped plates 12 spaced a distance apart and rigidly connected together by means of a plurality of curved vanes 29 disposed similarly to those of wheel 41. The overall width of wheel 11 corresponds to that of wheel 41 with the outer periphery of each plate 12 bearing snugly against the inner wall of member 51. To prevent axial movement of wheel 11 the inner peripheral edge of each plate 12 may be tapered to engage into a V-shaped notch (not shown) provided around the outer periphery of each plate 42.

Radially mounted opposite each other along part of the outer periphery of each plate 12 and extending axially outwardly therefrom are two curved flaps 10 having their outer surfaces bearing snugly against the inner wall of member 51, flaps 10 being disposed axially opposite each other on wheel. The overall width and chord dimensions of flaps 10 substantially correspond respectively to the axial dimension of recess 32 and to the inside diameter of vertical member 6.

Part of the inside surface of vertical member 6 is inclined inwardly and upwardly from a point 53 on one side of the inner surface to a point 52 spaced from the opposite side inner surface. Such inclined surface has a width substantially equal to that of wheels 41 and 11 to form a deflecting flat surface 7 and a tongue 33 whose upper surface is part of the inner periphery of member 51.

Figure 2:
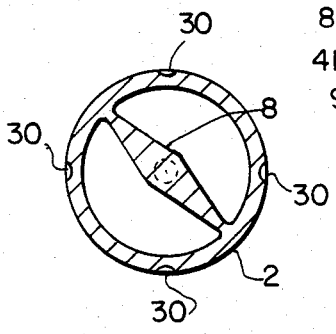
FIG. 2 is a cross-sectional vertical elevation view of a control ring vertically shown in FIG. 1.

As shown in FIG. 2, integrally formed with the axially outer end of blade 8 is an annular ring 2 having an outer periphery slidably fitting within the inner wall of member 51. Spaced around the outer periphery of ring 2 are a plurality of recesses or notches 30 formed therein, for example four notches as shown.

Extending downwardly beneath ring 2 through a nut 15 provided with a seal 17 and in line with ring 2 is a vertical spring-loaded rod 47 thrusting upwardly a ball 13 fitting snugly into one of the notches 30. The upward thrust of rod 47 is effected by means of a spring 16 mounted on rod 47 and within nut 15 securely screwed into a boss 14 forming part of casing 1. Fastened to the bottom end of rod 47 is a flexible element 46 in the form of a taut nylon cord extending vertically and downwardly through two superposed brackets 18 and 19 projecting outwardly from the base of vertical member 6, the bottom end of flexible element 46 being fastened to and underneath bottom bracket 19.

The top outer portion of stationary coupling 28 is circular with its surface provided with fine vertical serrations 43 and carries two superposed cicular clips 25 and 24 on which are mounted respectively arms 21 and 22 extending outwardly and upwardly as shown. On top of arm 21 is a threaded block 45 carrying an interceptor screw 20, whereas on top of arm 22 is a threaded block 44 carrying an interceptor screw 23.

Each of interceptor screws 20 and 23 is adjustable lengthwise and located at an elevation corresponding to the horizontal plane lying approximately at the center of the space between brackets 18 and 19. Clips 24 and 25 are split and provided with fine serrations on their inner peripheries interlocking with serrations 43 for positive setting yet each can be readily moved around coupling 28 for setting screws 23 or 20 in various desired positions.

In accordance with the present embodiment, the invention operates as follows:

Casing 1 is mounted in a substantially vertical position by means of coupling 28 onto a source of fluidic material under pressure (in this case, water). The water rushes upwardly through pipe 27 and vertical member 6 into horizontal member 51 and port 39 via recess 32 and out in the form of a jet through spout 38 of nozzle 3.

Figure 3:
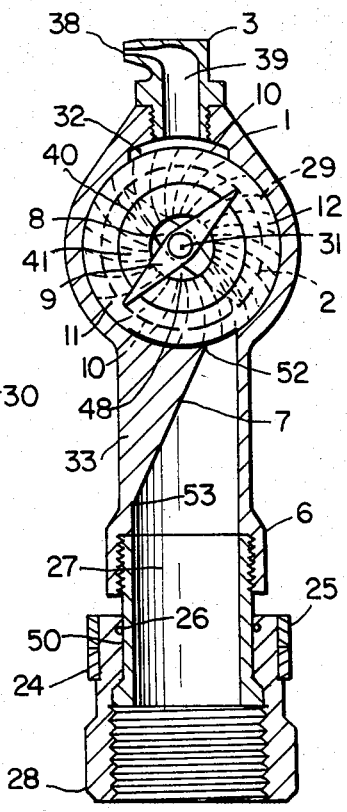
FIG. 3 is a side elevation view of the device shown in FIG. 1, with only the casing being shown in cross-section.
Figure 4:
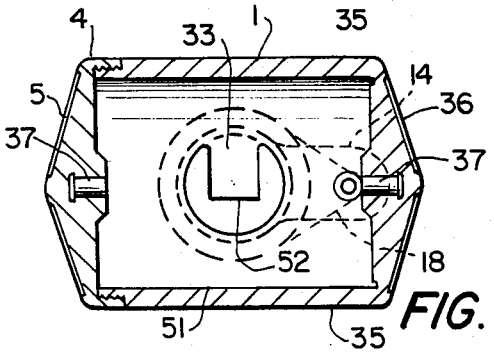
FIG. 4 is a horizontal cross-sectional view of the casing of the device shown in FIG. 1 taken along the axis of the horizontal casing member.
Figure 5:
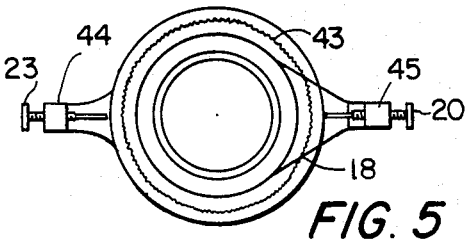
FIG. 5 is a horizontal cross-sectional view taken immediately above an upper bracket shown in FIG. 1.
Figure 7:
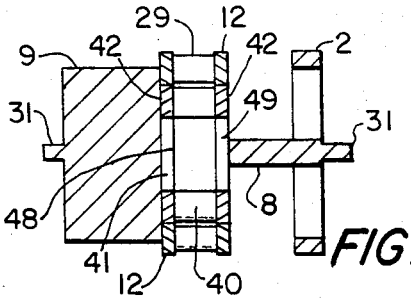
FIG. 7 is a cross-sectional view showing the assembly of the propeller blades-turbine wheels-ring-stub shafts taken along the axis and across the radial line joining the tips of left blade shown in FIG. 1.

However, part of the water flowing toward nozzle 3 is deflected upwardly along surface 7 through vanes 29 of wheel 11 and vanes 40 of wheel, 41 and out lateral openings 48, 49 in wheel plates 42, to nozzle 3. Since wheel 11 is freely mounted on the rims of wheel 41, wheel 11 rotates (counterclockwise when viewed as shown in FIG. 3) along with flaps 10 under the pressure of the water, while wheel 41 stays stationary under the checking action of ball 13 thrusting upwardly into one of notches 30 of wheel 2. In addition, the pressure of the water acting on the propeller formed by blades 8 and 9 causes casing 1 along with nozzle 3 and thus the jet of water being discharged from spout 38 of nozzle 3 to rotate about the vertical axis of vertical member 6 due to the relative rotation between pipe 27 and coupling 28. However, as they rotate, the flaps 10 of wheel 11 obstruct periodically and partially the flow of water to nozzle 3 thereby causing a back and forth pattern of the jet of water being discharged from spout 38 of nozzle 3.

When flaps 10 are in the positions shown in FIG. 3, they simultaneously cover partially the area of flow of recess 32 and that of member 6, thereby restricting the flow of water which can only then find its way through vanes 29 and 40 to nozzle 3 resulting in a lesser pressure therein and thus causing the water to fall closer through a weaker jet from spout 38. However, as flaps 10 continue to rotate under the pressure of the water flowing through vanes 29 of wheel 11, they gradually uncover the areas of flow of both recess 32 and member 6, thereby causing the pressure within nozzle 3 to gradually increase and the jet of water being discharged from spout 38 to gradually fall further.

Figure 8:
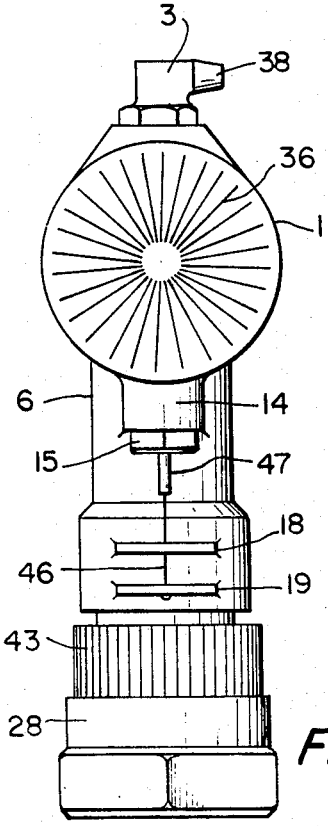
FIG. 8 is an elevation view from the left side of the assembly shown in FIG. 7.
Figure 6:
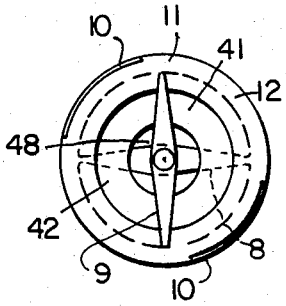
FIG. 6 is an external elevation view taken from the right side of FIG. 1 with clips thereof removed.

The direction of rotation of casing 1 depends on the relative positions of blades 8 and 9. When the blades are in the positions shown in FIGS. 1 and 3, the resultant horizontal pressure of the water flowing against each of them creates a couple causing casing 1 to rotate in a clockwise direction when viewed from the top. However when either of propeller blades 8 and 9 is vertical and the other horizontal as shown in FIG. 8, no couple is present and rotation of casing 1 would cease if it were not for wheel 41 which, when released from the checking action of ball 13, rotates both blades 8 and 9 forcing them into reversed propelling positions.

The reversal in position of blades 8 and 9 is effected as follows. Assuming that casing 1 is in the position shown in FIGS. 1 and 3 rotating clockwise (when viewed from the top), with interceptor screws 20 and 23 set as shown, flexible element 46 which also moves along with casing 1 will ultimately encounter interceptor screw 20 thereby forcing element 46 to flex laterally, thus pulling down rod 47 against spring 16 and causing ball 13 to drop down by gravity from bottom notch 30, thus releasing ring 2 and allowing smaller turbine wheel 41 to rotate blades 8 and 9 counterclockwise until blade 9 reaches a vertical position and blade 8 a horizontal position as shown in FIG. 8. At this precise moment, casing 1 ceases to rotate momentarily, then starts rotating again but counterclockwise as the positions of blades 8 and 9 are gradually reversed by further rotation of turbine wheel 41. During the reversal of blades 8 and 9, ball 13 bears against the rim of ring 2 under the pressure of spring 16 until encountering the next notch 30 into which ball 13 then snaps to lock blades 8 and 9 in their now fully reversed propelling positions. The direction of rotation of casing 1 is similarly reversed when flexible element 46 encounters interceptor screw 23. Continuous rotation of casing 1 can be effected by withdrawing both interceptor screws 20 and 23 so that they clear flexible element 46.

Although a specifically preferred embodiment of automatic sprinkling device according to the present invention has been described and illustrated, it is to be understood that various modifications to the specifically described and illustrated arrangements may be made without departing from the scope of the present invention.

What is claimed is:

1. An automatic sprinkling device comprising:

a hollow casing including a generally vertically extending cylindrical portion having lower and upper ends and a generally horizontally extending cylindrical portion integral with said upper end of said vertical portion;

coupling means, rotatably and sealingly connected to said lower end of said vertical portion of said casing, for connecting said casing to a source of pressurized fluid;

a nozzle fixed to and extending from said horizontal portion of said casing and communicating with the interior thereof for spraying therefrom a jet of pressurized fluid;

propeller means positioned within said casing to be contacted by pressurized fluid passing therethrough for causing said casing and said nozzle to rotate with respect to said coupling means, said propeller means comprising a first turbine wheel mounted within said horizontal portion, and propeller blades fixed to and extending axially from opposite ends of said first turbine wheel, said propeller blades being noncoplanar with respect to each other;

control means for selectively regulating and reversing the rotation of said casing and said nozzle with respect to said coupling means; and means mounted within said casing and contacted by the pressurized fluid passing therethrough for periodically restricting the jet of pressurized fluid sprayed from said nozzle.

2. A device as claimed in claim 1, wherein said blades extend in planes generally perpendicular to each other.

3. A device as claimed in claim 2, wherein said control means comprises means for fixing said first turbine wheel and said blades with respect to said casing, whereby pressurized fluid passing through said casing acts on surfaces of said blades and causes said blades and said casing to rotate with respect to said coupling means.

4. A device as claimed in claim 3, wherein said fixing means comprises a ring integral with one of said blades and having in the outer periphery thereof circumferentially spaced recesses, and a spring biased member extending from said casing into one said recess to retain said ring, said one blade and said first turbine wheel and the other blade in a fixed position relative to said casing.

5. A device as claimed in claim 4, wherein said control means further comprises means for withdrawing said spring biased member from said one recess, thereby freeing said ring, said blades and said first turbine wheel for rotation relative to said casing, whereby pressurized fluid passing through said casing causes said first turbine wheel to rotate said blades and said ring relative to said casing to a position whereat said spring biased member extends into another said recess in said ring and said blades extend in relative directions such that pressurized fluid passing through said casing causes said blades and said casing to rotate in an opposite direction with respect to said coupling means.

6. A device as claimed in claim 5, wherein said spring biased means comprises a ball, a rod extending vertically through a wall of said casing and contacting said ball, and a spring urging said rod into said casing and said ball toward said ring, and said withdrawing means comprises a laterally flexible member connected to said rod, and at least one abutment fixed with respect to said coupling means and adapted to be abutted by said laterally flexible member upon rotation of said casing, thereby flexing said laterally flexible member and moving said rod outwardly of said casing against the force of said spring.

7. A device as claimed in claim 1, wherein said restricting means comprises a second turbine wheel mounted within said horizontal portion for rotation independently of said first turbine wheel, and flaps extending from said second turbine wheel for varyingly blocking the flow of pressurized fluid through said casing upon rotation of said second turbine wheel.

8. A device as claimed in claim 7, wherein said second turbine wheel is concentrically mounted about the exterior of said first turbine wheel.

9. A device as claimed in claim 7, wherein said restricting means further comprises a deflector within said vertical portion for directing a part of the pressurized fluid toward said turbine wheels, thereby causing said second turbine wheel to rotate continuously.

10. A device as claimed in claim 9, wherein said deflector comprises an inclined surface of said vertical portion.

11. A device as claimed in claim 7, wherein each of said turbine wheel comprises a pair of spaced, parallel annular plates connected by a plurality of curved vanes.

* * * * *